United States Patent [19]

Geeslin et al.

[11] 4,230,106

[45] Oct. 28, 1980

[54] ARTICULATED SNORKEL

[76] Inventors: John W. Geeslin, c/o George Spector, 3615 Woolworth Bldg., 233 Broadway, New York, N.Y. 10007; George Spector, 3615 Woolworth Bldg., 233 Broadway, New York, N.Y. 10007

[21] Appl. No.: 905,334

[22] Filed: May 12, 1978

[51] Int. Cl.[2] ..... B63C 11/16

[52] U.S. Cl. ..... 128/201.11; 128/207.16

[58] Field of Search ..... 128/145 A, 145 R, 147, 128/142 R

[56] References Cited

U.S. PATENT DOCUMENTS

| | | | |
|---|---|---|---|
| 3,051,170 | 8/1962 | Benzel | 128/147 |
| 3,860,042 | 1/1975 | Green | 128/145 A |
| 4,022,201 | 5/1977 | Diggs | 128/145 A |
| 4,055,174 | 10/1977 | LeVasseur | 128/145 A X |

FOREIGN PATENT DOCUMENTS

| | | | |
|---|---|---|---|
| 143839 | 8/1903 | Fed. Rep. of Germany | 128/145 A |
| 1322898 | 2/1963 | France | 128/145 A |
| 529214 | 6/1955 | Italy | 128/145 R |

*Primary Examiner*—Henry J. Recla

[57] ABSTRACT

A snorkel for swimmers, having a basic concept of hydraulic bladders connected by tubes which block or open a blow hole of the snorkel tube; the bladder being under constant pressure from its own elastic walls collapsing when pressure from a jaw or tongue on the bladder is released by the separation of the teeth or drawing back of the tongue, thus opening the air tube, allowing inflow of air normal inhalation of the lungs.

3 Claims, 8 Drawing Figures

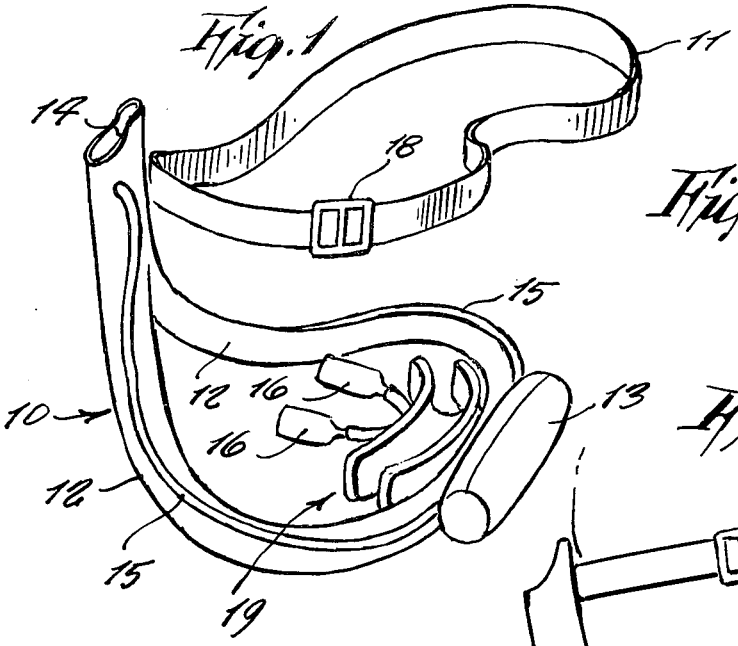
Fig. 1
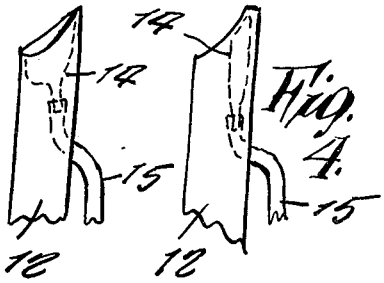
Fig. 3
Fig. 4.
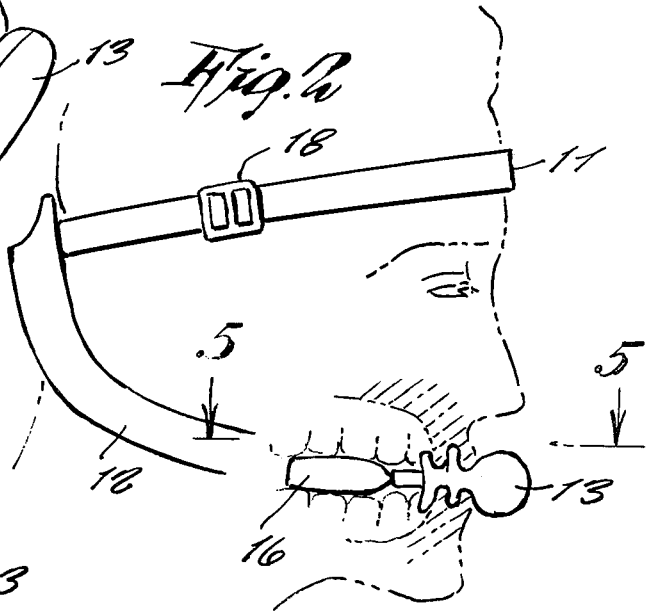
Fig. 2
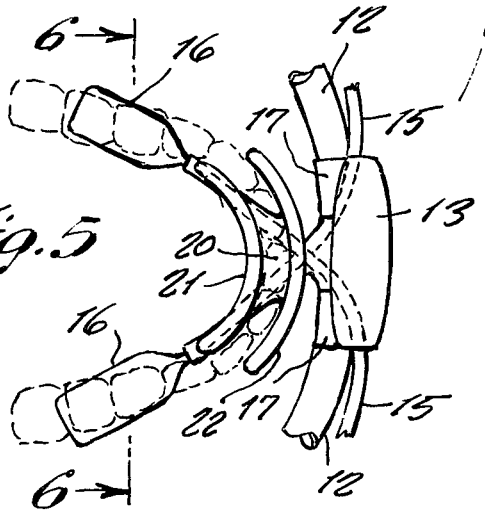
Fig. 5
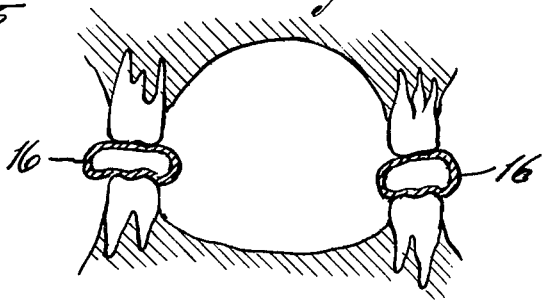
Fig. 6
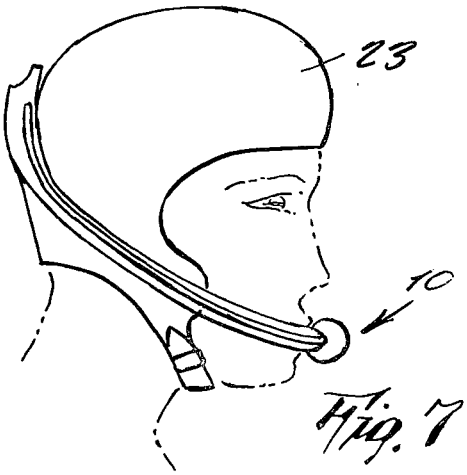
Fig. 7
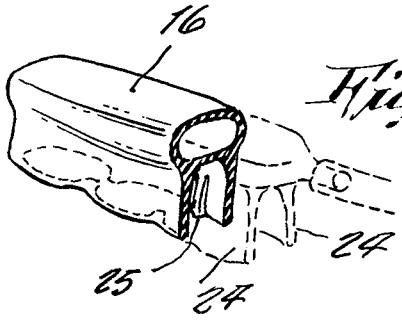
Fig. 8

ARTICULATED SNORKEL

This invention relates generally to snorkels for swimmers.

A principal object of the present invention is to provide a swimmer's snorkel which has the advantage of a whale by having an articulated blow hole at a back of a head.

Another object is to provide a swimmer's snorkel having the advantage over a conventional snorkel in that the tube can be sealed at a fresh air inlet between breathes, preventing water entrance.

Still another object is to provide a swimmer's snorkel which is more streamlined than a conventional one.

Still another object is to provide a swimmer's snorkel which could be integrated into a swimming cap.

Other objects are to provide a swimmer's snorkel which is simple in design, inexpensive to manufacture, rugged in construction, easy to use and efficient in operation.

These and other objects will be readily evident upon a study of the following specifications and the accompanying drawing wherein:

FIG. 1 is a perspective view of the invention.

FIG. 2 is a side view thereof shown partly broken away so to illustrate how the device is held between the teetch in a mouth.

FIG. 3 is an enlarged detail of the tube bladder shown in a side view.

FIG. 4 shows it in an end view.

FIG. 5 is a view in direction 5—5 of FIG. 2.

FIG. 6 is a cross-sectional view in direction 6—6 of FIG. 5.

FIG. 7 illustrates a design of the invention incorporated into a bathing cap.

FIG. 8 illustrates another design of mouth bladder which includes a downward band so to snap around the lower teeth in order that the bladder will not disalign accidently from between the upper and lower teeth.

Referring now to the drawing in detail, and more particularly to FIGS. 1 through 5 at this time, the reference numeral 10 represents an articulated snorkel according to the present invention, wherein there is an elastic head band 11 that supports air supply tubes 12 connected to a mouthpiece 13 which communicates via conventional passageway with air supply tubes 12. A common rear end of the air supply tubes providing the conventional blow hole is fitted with a tube bladder 14 from where a pair of bladder connecting tube 15 extend to a pair of mouth bladders 16. A flapper purge valve 17 is at each end of the mouthpiece 13.

The flapper purge valves are for clearing water from the tubes when a the blow hole is closed as will be described. Exhaling through the mouthpiece will push the flapper purge valves outward and cause purging of water in the air tubes 12.

While swimming or surface diving, purging of water in the tubes would be by exhaling at the surface as a conventional snorkel or through the purge flapper valves when the bladder 14 is inflated to close the rear end (blow hole) of the tubes 12.

The elastic head band is adjustable in size by means of sliding clip 18.

The head band is attached to upper rear ends of the two air supply tubes 12 at the common rear end where the tube bladder 14 is located. Each air supply tube 12 extends around a cheek of the swimmer's head. The mouthpiece 13 is located directly in front of the person's mouth, and a bit 19 thereof extends inside the mouth; the bit including a plate 20 for being held between the front upper and lower teeth. An arcuate vertical flange 21 and 22 at front and rear edges of plate 20 serve as guides for retaining the plate properly between the teeth.

The bladder connecting tubes 15 extending from the tube bladder, are each positioned alongside the air supply tube 12 as it extends around the wearer's cheek. A lower forward end of the bladder connecting tubes 15 extend into the bit 19 and outward of a rear end thereof where they each terminate in a mouth bladder 16 that is each placed between upper and lower side teeth in order to be squeezed therebetween for successive inflation and deflation as suggested in FIGS. 2 and 6 i.e. when deflation of bladder 16 by teeth pressure causes inflation of bladder 15 and resulting closure of the rear end (blow hole) of the tubes.

In FIG. 7, the present invention is show incorporated with a bathing cap 23 that is worn on the swimmer's head; the cap replacing the above-described elastic head band for support of the invention.

In FIG. 8, a further modified design of the invention includes each mouth bladder 16 being incorporated with a downward band 24 for fitting along opposite sides of a row of teeth, in order to lock the mouth bladder firmly in position between the upper and lower teeth and prevent it to slip away from therebetween, so that it is always ready for being squeezed so to deflate. Ribs 25 on the inner side of the band 24 fit into spaces between the teeth so that the band contour fits the teeth precisely.

While various changes may be made in the detail construction, it is understood that such changes will be within the spirit and scope of the present invention as in defined by the appended claims.

What is claimed as new is:

1. An articulated snorkel, comprising in combination a support for being worn around a person's head, a pair of air supply tubes adapted to extend around opposite sides of said person's head, each tube terminating at the rear end thereof in a common tubular opening including a normally deflated tube bladder, a mouthpiece at a forward end of each of said air supply tubes connected to and in communication with said mouthpiece, said mouthpiece adapted to be positioned in the mouth of said person for communication therewith, with said air supply tubes extend around the person's head and said common tubular opening in the rear of the person's head, a bit integral with said mouthpiece for placement between front teeth, a pair of normally inflated mouth bladders mounted to and extending from said bit for being squeezed between side teeth of said person, a pair of connecting tubes connecting said tube bladder with said mouth bladders whereby upon squeezing said mouth bladders causes inflation of the normally deflated tube bladder, means to retain said mouth bladders aligned between said side teeth and flapper purge valves mounted at each end of said mouth piece.

2. The combination as set forth in claim 1 wherein said support comprises a bathing cap.

3. The combination as set forth in claim 1 wherein said retaining means comprises a downward band on each said mouth bladder for fitting on opposite sides of a row of said teeth, said bands being contoured to fit said teeth row.

* * * * *